US005248847A

United States Patent [19]

Aoyama

[11] Patent Number: 5,248,847

[45] Date of Patent: Sep. 28, 1993

[54] DEVELOPING CONTAINER STORING A LIQUID DEVELOPER WITH PUMP DISPENSER

[75] Inventor: Yuichi Aoyama, Tokyo, Japan

[73] Assignee: Ricoh Company, Ltd., Tokyo, Japan

[21] Appl. No.: 887,132

[22] Filed: May 22, 1992

[30] Foreign Application Priority Data

May 23, 1991 [JP] Japan ..... 3-146553

[51] Int. Cl.[5] ..... G03G 15/06

[52] U.S. Cl. ..... 118/659; 222/385; 222/DIG. 1; 355/256; 355/260

[58] Field of Search ..... 355/260, 256; 118/659, 118/653; 222/DIG. 1, 336, 339, 385, 340

[56] References Cited

U.S. PATENT DOCUMENTS

| | | | |
|---|---|---|---|
| 3,173,585 | 3/1965 | Kahn | 222/336 |
| 3,749,289 | 7/1973 | Levy | 222/DIG. 1 |
| 3,885,709 | 5/1975 | Levy | 222/DIG. 1 |
| 4,176,764 | 12/1979 | Capra et al. | 222/340 X |
| 4,220,264 | 9/1980 | Gamadia | 222/336 X |
| 4,964,544 | 10/1990 | Hanna et al. | 222/385 X |

FOREIGN PATENT DOCUMENTS

| | | | |
|---|---|---|---|
| 0115239 | 10/1978 | Japan | 118/659 |
| 0067873 | 6/1981 | Japan | 355/256 |
| 0034880 | 2/1990 | Japan | 355/256 |

*Primary Examiner*—A. T. Grimley
*Assistant Examiner*—Robert Beatty
*Attorney, Agent, or Firm*—Oblon, Spivak, McClelland, Maier & Neustadt

[57] ABSTRACT

A developing device incorporated in a copier for supplying a toner from a toner container to a reservoir to feed a toner-containing liquid developer to a developing unit. A developer feeding mechanism is disposed in the reservoir for feeding the toner-containing liquid developer to the developing unit. The liquid developer is circulated from and to the developing feeding mechanism along a circulation path. A discharging device for discharging the toner has an outlet which is open to the circulation path.

8 Claims, 13 Drawing Sheets

DEVELOPING CONTAINER STORING A LIQUID DEVELOPER WITH PUMP DISPENSER

BACKGROUND OF THE INVENTION

The present invention relates to a developing device incorporated in a copier for feeding a toner from a toner container to a liquid reservoir to thereby supply a toner-containing liquid developer to a developing unit.

A developing device of the type described is disclosed in, for example, Japanese Utility Model Application No. 333362/1990, and has a liquid reservoir, a toner container, actuating means for toner supply, and developer feeding means. The toner container has a container body filled with a toner, and discharging means for discharging the toner to the outside of the container body via a nozzle in association with an action for toner supply effected at the outside. The actuating means operates the discharging means. The developer feeding means is disposed in the liquid reservoir for feeding the toner-containing liquid developer to a developing unit. The device supplies the toner via the nozzle of the toner container until the toner in the liquid reaches a predetermined concentration, while sensing the toner concentration by a concentration sensor.

One of conventional toner containers has a first chamber to be inflated by a gas, and a second chamber storing a toner therein and contracting when the first chamber inflates, as taught in Japanese Utility Model Laid-Open Publication No. 125457/1989. However, this kind of toner container has various problems, as follows. The container body has to be implemented as a pressure container resistive to a pressure of 15 kilograms per square centimeter. It is necessary to use furon gas or similar toxic gas which pollutes the environment. Since the wet toner contains an organic solvent, the toner container is apt to burst when thrown into fire. In addition, an extra step is needed to check the crimped portion of valve means as to the leakage of the toner, increasing the cost of the toner container.

SUMMARY OF THE INVENTION

It is therefore an object of the present invention to provide an inexpensive and large capacity developing device for the above-described type of copier which does not need a pressure container, a toxic gas, or an extra checking step.

In accordance with the present invention a developing device for a copier using a liquid developer comprises a reservoir storing a liquid developer, a toner container removably mounted on the reservoir and comprising a container body storing a toner and discharging means for discharging the toner from a nozzle to the outside of the container body via an outlet in association with a toner supply action effected at the outside, actuating means for actuating the discharging means of the toner container, and developer feeding means disposed in the reservoir for feeding the liquid developer containing the toner to a developing unit. The outlet of the discharging means is open to a circulation path for circulating the liquid developer from and to the developer feeding means.

Also, in accordance with the present invention, a developing device for a copier using a liquid developer comprises a reservoir storing a liquid developer, a toner container removably mounted on the reservoir and comprising a container body storing a toner and discharging means for discharging the toner from a nozzle to the outside of the container body via an outlet in association with a toner supply action effected at the outside, actuating means for actuating the discharging means of the toner container, and developer feeding means disposed in the reservoir for feeding the liquid developer containing the toner to a developing unit. The toner container comprises a nozzle constituting a connecting member in a connecting portion where the outlet and a contact member of the actuating means are connectable to each other. The contact member of the actuating comprises a joint member including a guide portion for guiding the nozzle. The nozzle and joint member are held in close contact by a packing. The nozzle has its root spaced apart by a clearance of at least 3 millimeters from the guide portion when the nozzle is pushed for supplying the toner.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

FIGS. 1–14 show a developing device embodying the present invention. Since the embodiment and the above-discussed conventional developing device generally resemble in construction, the following description will concentrate on their differences.

Figure 1:
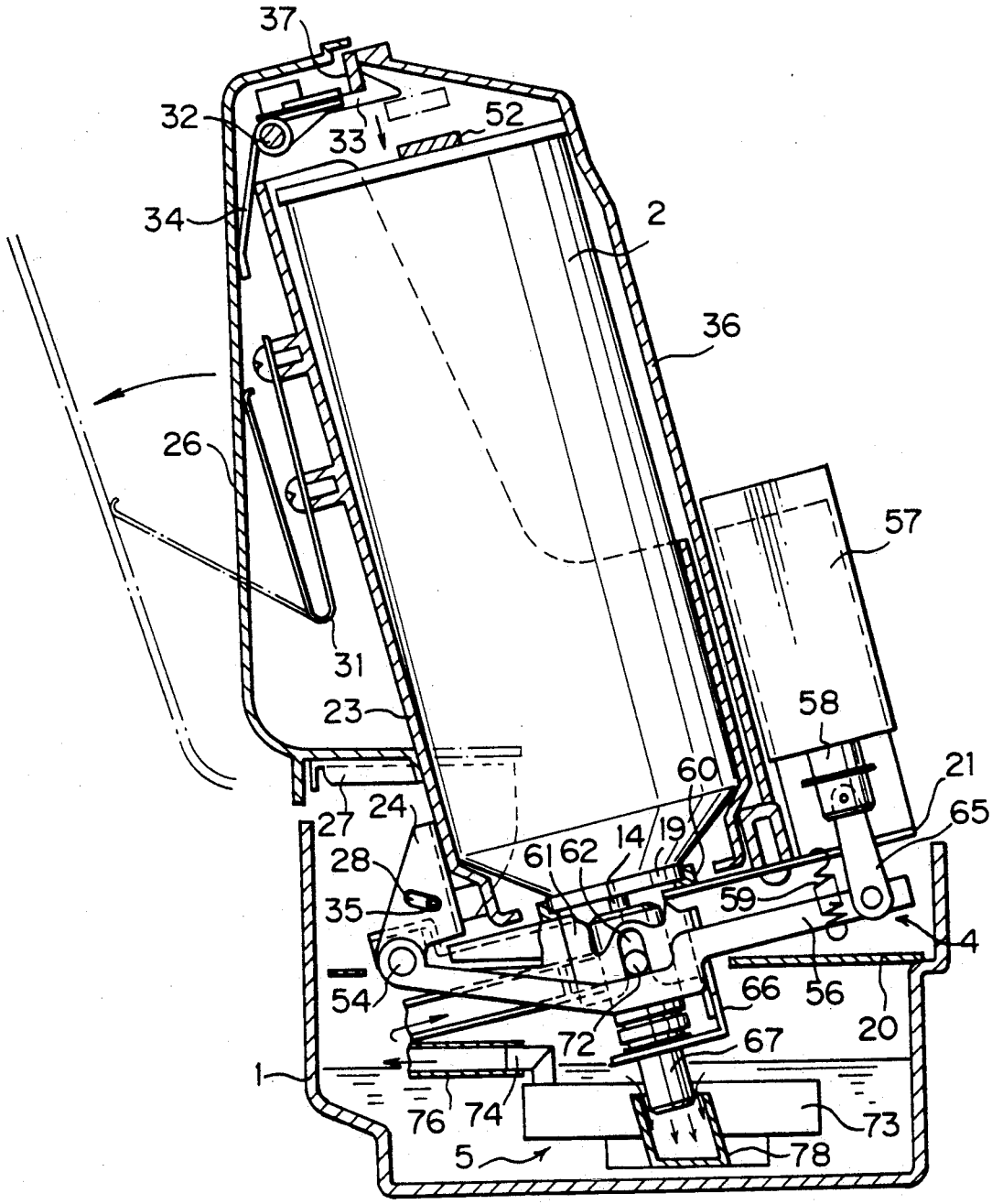
FIG. 1 is a partly taken away sectional front view of a developing device embodying the present invention.
Figure 2:
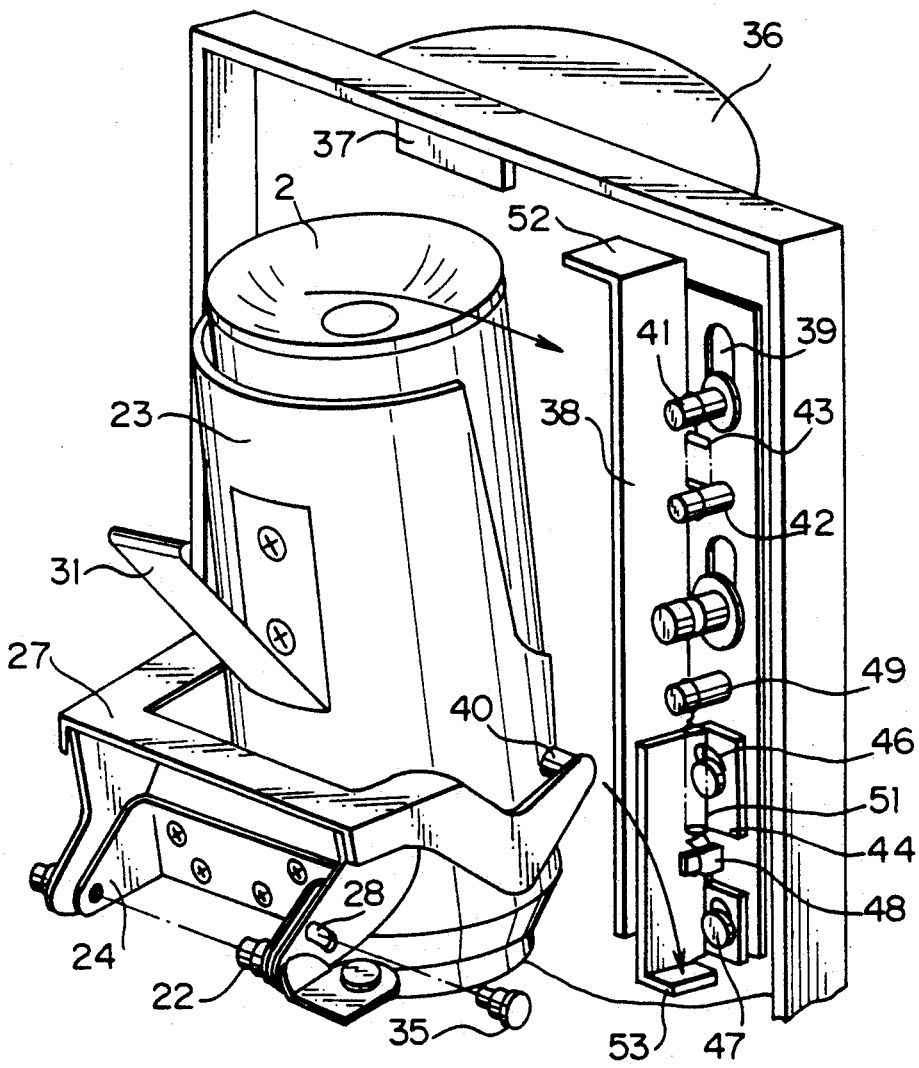
FIG. 2 is a fragmentary perspective view of the embodiment.

As shown, the developing device has a top-open reservoir 1 storing a liquid developer therein. A reservoir base plate 20 is affixed to the inner periphery of the reservoir 1 adjacent to the open end of the latter while a base plate 21 is affixed to the reservoir base plate 20 in an inclined position. An inner holder 23 receives a toner container 2 removably therein and has a bracket 24 which is connected to the base plate 21 by a pivot shaft at the base end thereof. A front cover 26 has a bracket 27 which is also pivotally connected to the base plate 21. A pin 35 is studded on the holder bracket 24 and slidably received in an arcuate slot 28 which is formed through the front cover bracket 27. The front cover bracket 27 has a rearward extension, and a pin 40, FIG. 2, is studded on the free end of the rearward extension. A spring 31 is affixed to the outer surface of the inner holder 23 which faces the inner surface of the front cover 26. A pivot shaft 32 is mounted on an upper portion of the front cover 26 and extends to the outside of the front cover 26 at one end thereof. A handle, not shown, is affixed to the end of the pivot shaft 32 at the outside of the front cover 26. A hook 33 is affixed to the pivot shaft 32 and constantly biased counterclockwise as viewed in FIG. 1 by a spring 34.

A rear cover 36 extends upward from the base plate 21 and faces the front cover 26. The rear cover 36 has a locking portion 37 at the upper end thereof which is capable of mating with the hook 33. A pressing plate 38, FIG. 2, is mounted on the rear cover 36 adjacent to one side edge of the latter and movable up and down. Two vertically extending slots 39 are formed through an upper portion the pressing plate 38. Threaded guide pins 41 are driven into the rear cover 36, and each is received in one of the slots 39. A pin 42 is studded on the pressing plate 38 below the upper guide pin 41. A first tension spring 43 is anchored to the upper guide pin 41 and the pin 42 at opposite ends thereof. An auxiliary pressing plate 44 is supported by a lower end portion of the pressing plate 38 and movable up and down. Two vertically extending slots 46 are formed through an upper and a lower portion of the auxiliary pressing plate 44. Threaded guide pins 47 are driven into the pressing plate 38, and each is received in one of the slots 46. A second tension spring 51 is anchored at one end to a projection 48 located in the intermediate portion of the auxiliary pressing plate 38 and at the other end to a pin 49 studded on the pressing plate 38 above the projection 48. The tension spring 51 exerts a greater force than the tension spring 43. The pressing plate 38 has a pressing portion 52 at the upper end while the auxiliary pressing plate 44 has a pressure receiving portion 53 at the lower end.

Figure 3:
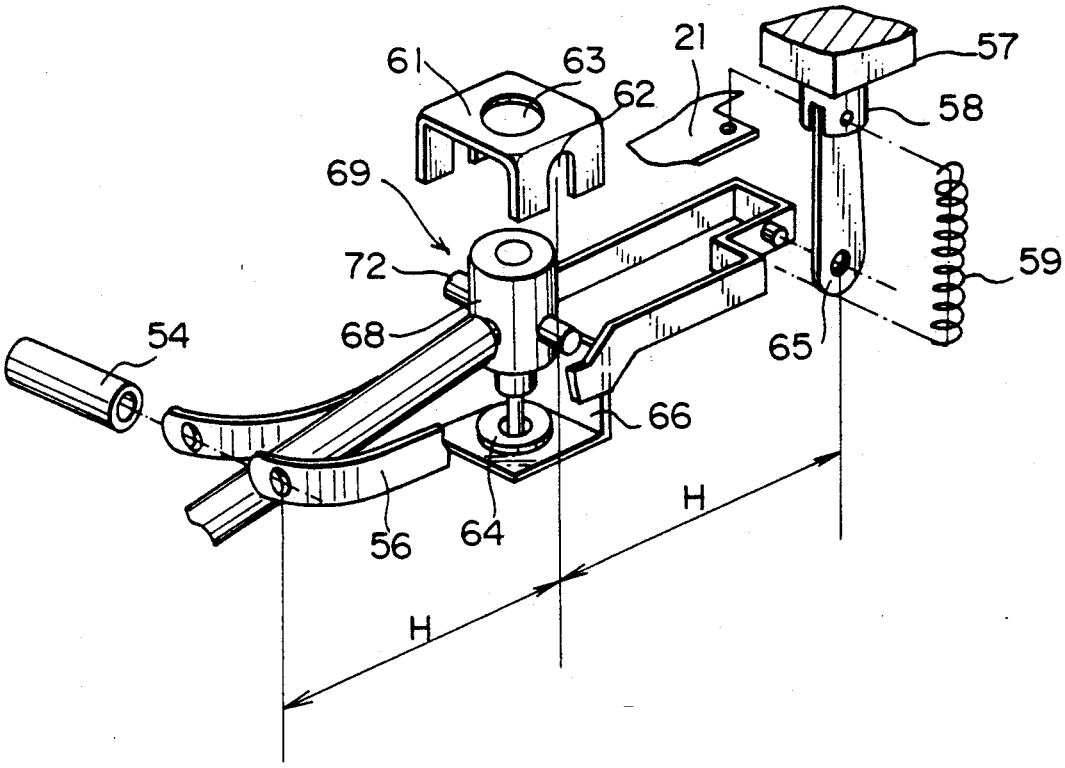
FIG. 3 is an exploded perspective view of another part of the embodiment.
Figure 5:
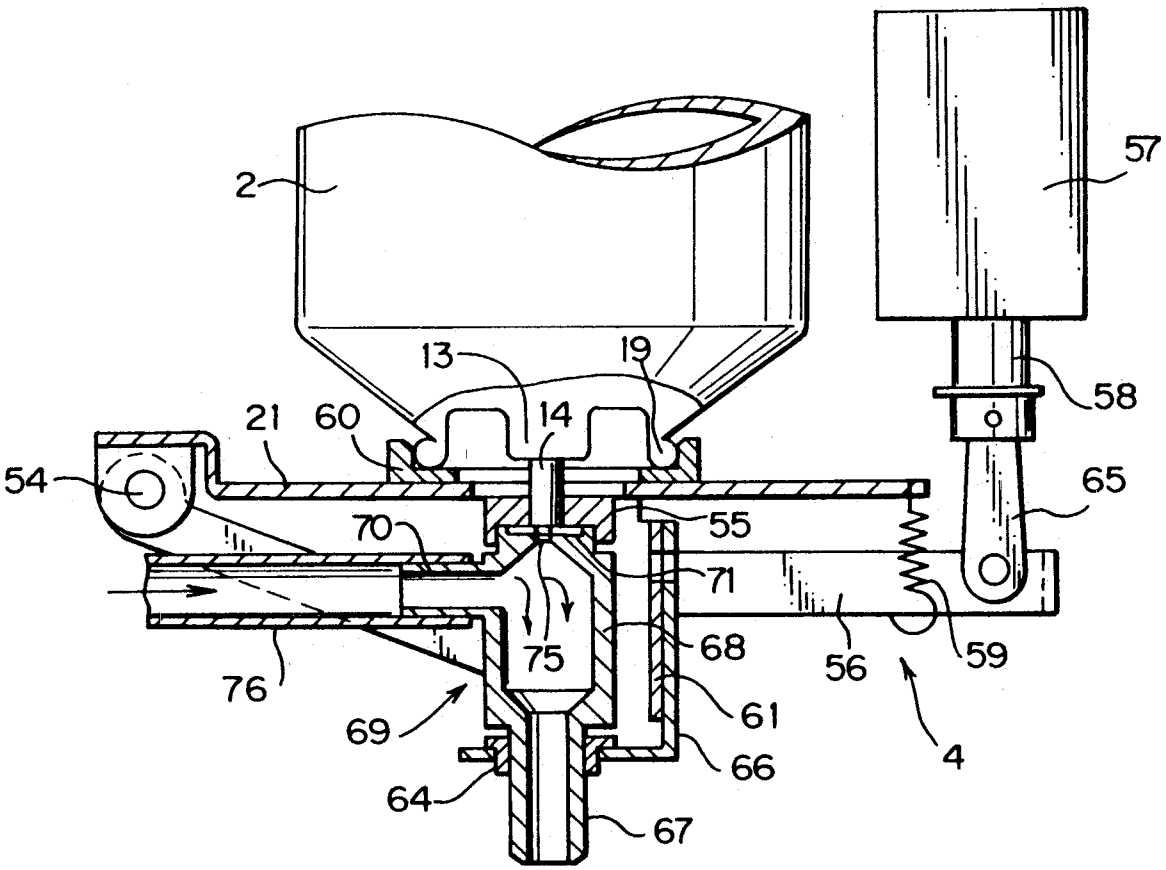
FIG. 5 is a fragmentary section showing the embodiment in a non-discharge condition.
Figure 6:
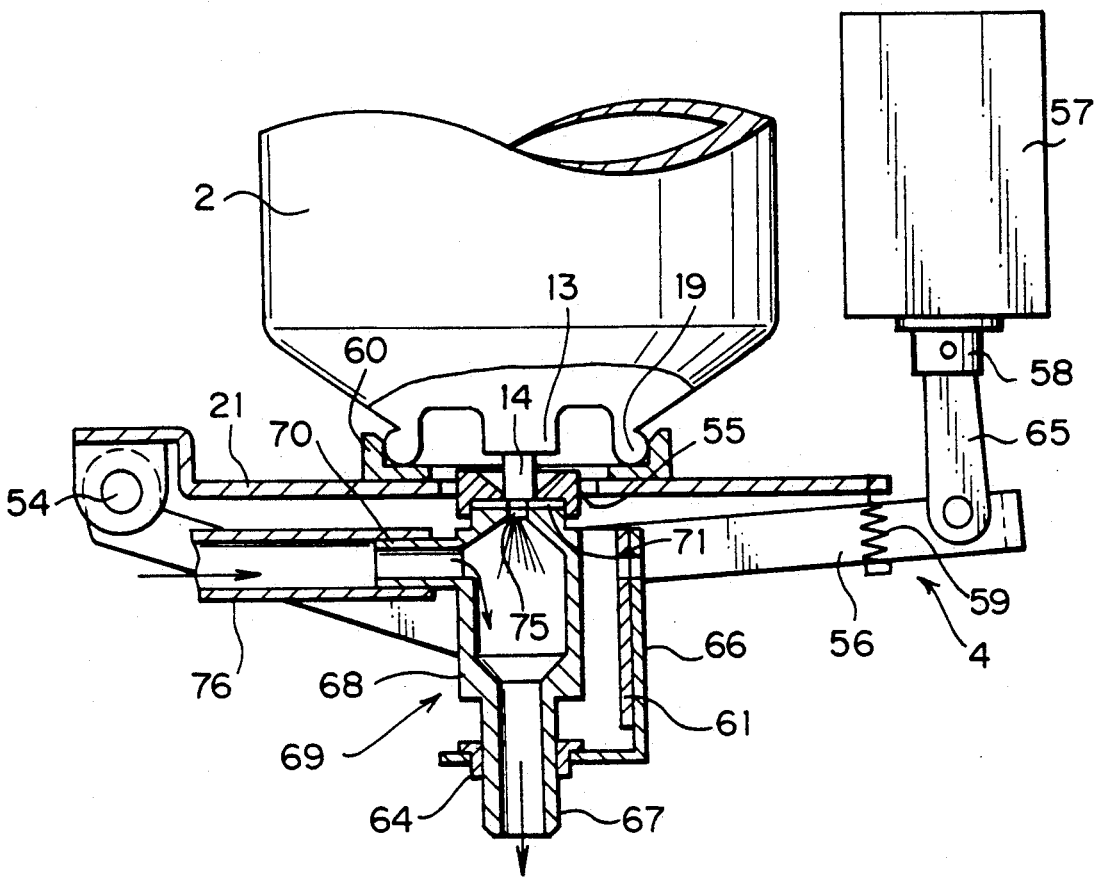
FIG. 6 is a view similar to FIG. 5, showing the embodiment in a discharge condition.

A pivot shaft 54 is mounted on the base plate 21 adjacent to one end of the latter and has the same axis as the pivot shaft 22. A solenoid 57 is mounted on the base plate 21 near the other end of the latter in an inclined position and has a plunger 58. An arm 56 is pivotally connected to the pivot shaft 54 at one end and connected to the plunger 58 of the solenoid 57 by a link 65 at the other end. A tension spring 59 is anchored to the arm 56 and the base plate 21 at opposite ends thereof. An opening 55, FIG. 5, is formed through substantially the center of the base plate 21. A seat 60 is fitted on the base plate 21 above the opening 55 for receiving a holl 15 of the toner container 2 that surrounds a mouth 13. A guide piece 61 is affixed to the base plate 21 below the opening 55. As best shown in FIG. 3, the guide piece 61 has a bottom-open box-like configuration including a center opening 63 and side notches 62. A generally L-shaped guide plate 66 has an upright portion thereof connected to the side wall of the guide piece 61 which is perpendicular to the arm 56. A hole is formed through the bottom wall of the guide plate 66 while a flexible packing 64, FIG. 3, is fitted in the hole.

Figure 4:
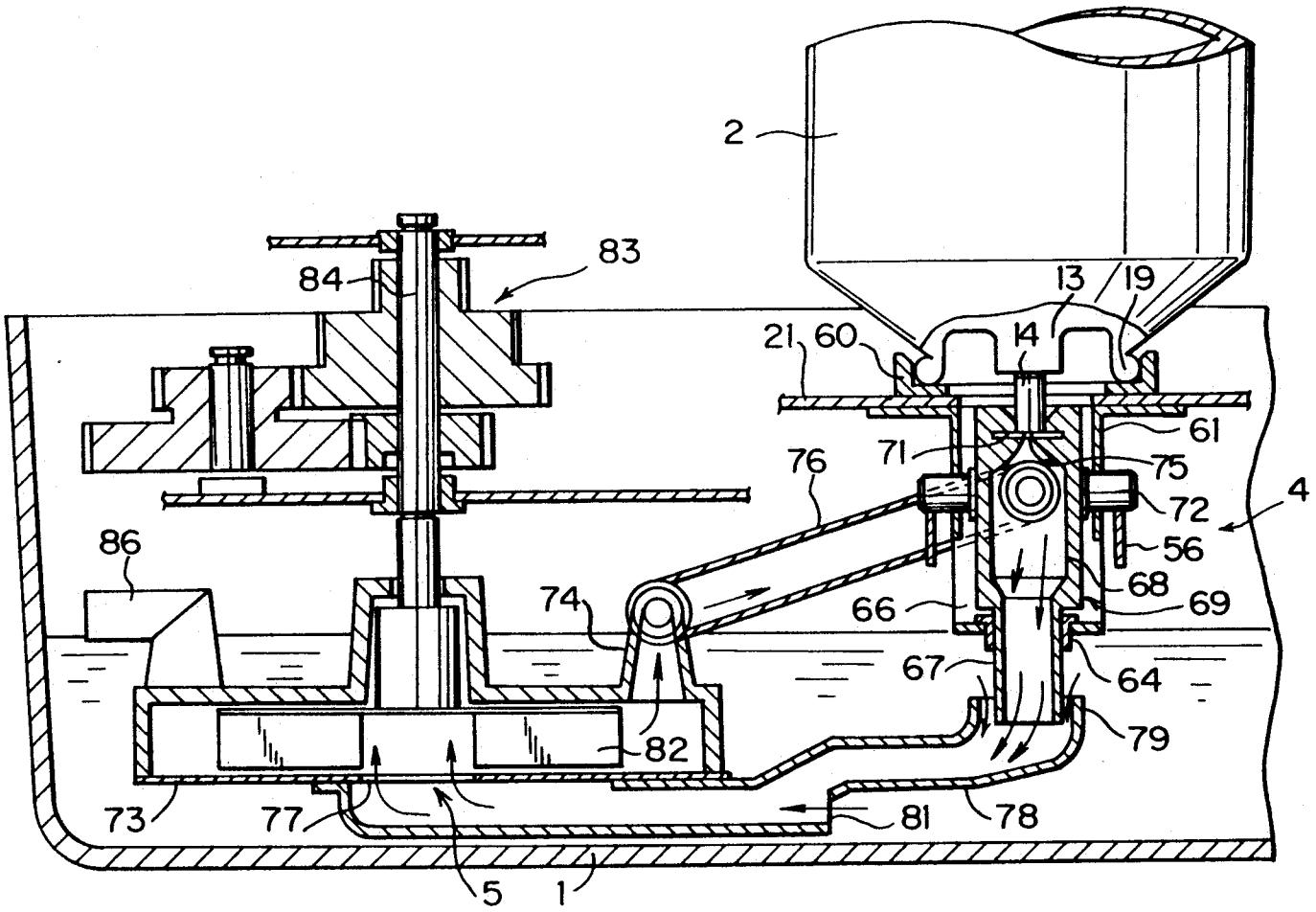
FIG. 4 is a vertical section showing still another part of the embodiment.

A joint member 69 is affixed to the bottom wall of the guide plate 66. As shown in FIG. 4, the joint member 69 has a tubular outlet 67 at the lower end and a hollow joint body 68 above the outlet 67. The tubular outlet 67 is removably received in the packing 64. A tubular inlet 70, FIG. 7, extends from one side of the joint body 68 in a substantially perpendicular direction. A packing 71 is fitted on the top of the joint body 68 in such a manner as to contact the nozzle 14 of the toner container 2. A hole 75 is formed through the packing 71 to communicate the hole 15 of the nozzle 14 and the inside of the joint body 68. Guide pins 72 extend out from the joint member 69 on a diameter perpendicular to the tubular inlet 70. The guide pins 72 are each received in one of the side notches 62 and supported by the upper edge of the arm 56.

A developer supply pump 5 includes a casing 73 having an outlet tube 74 at an upper peripheral portion thereof. A feed tube 76 communicates the outlet tube 74 to the tubular inlet 70 of the joint member 69. The casing 73 has an inlet 77 at the center of the bottom thereof. A return tube 78 communicates the tubular outlet 67 of the joint member 69 to the inlet 77. This conduitwork establishes a developer circulation path. The return tube 78 has an inlet opening 79 having a greater outside diameter than the outlet 67 and coupled over the outlet 67. An inlet opening 81 is formed through an intermediate portion of the return tube 78. A rotor 82 is accommodated in the casing 73 and operatively connected to the lower end of a rotary shaft 84 by a gearing 83. The shaft 84 is rotated by a drive member, not shown. The reference numeral 86 designates a feed tube for feeding the liquid developer to a developing unit, not shown.

Figure 8:
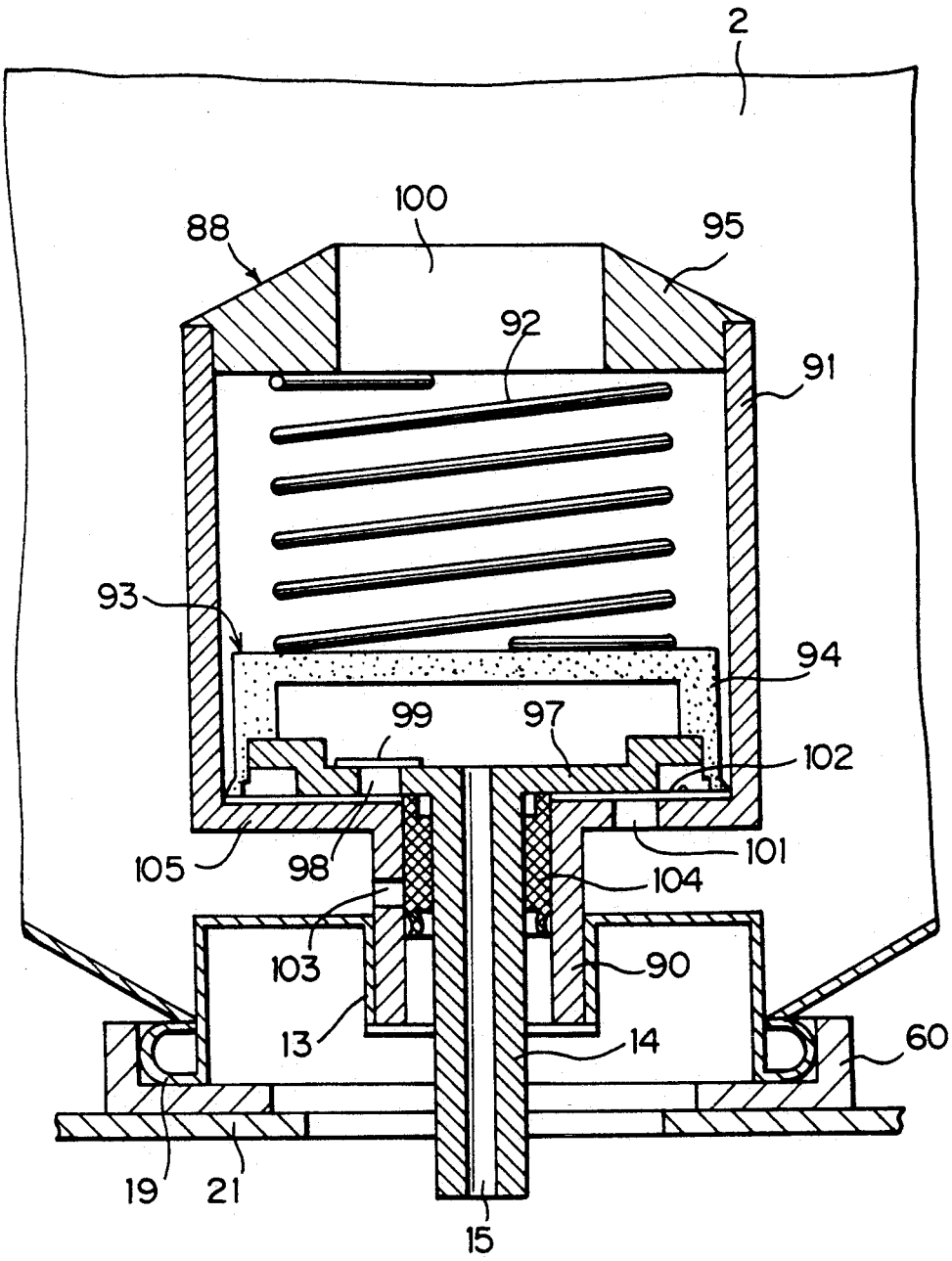
FIG. 8 is a vertical section showing the mouth portion of a toner container included in the embodiment and having a specific configuration in a closed position.
Figure 9:
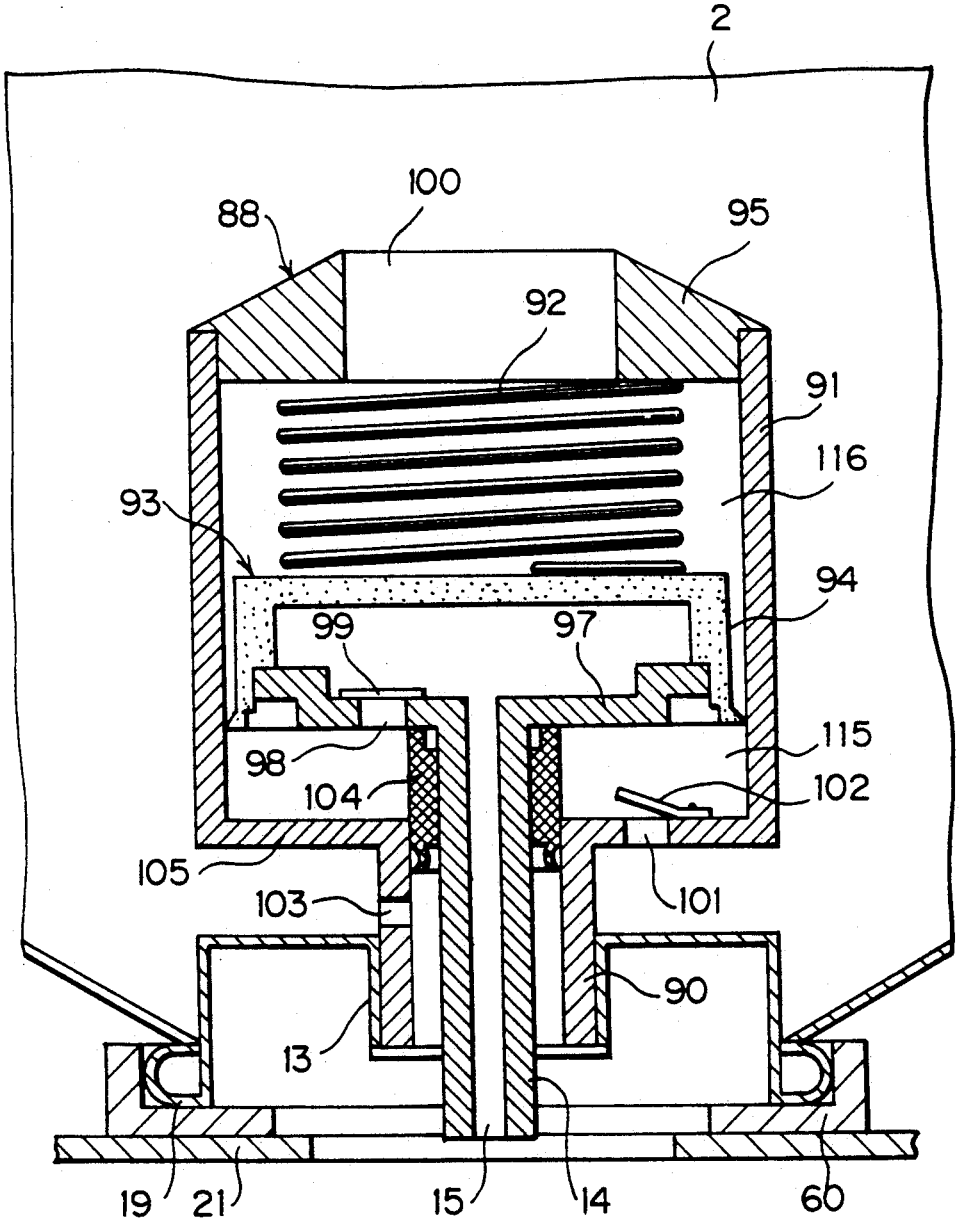
FIG. 9 is a view similar to FIG. 8, showing a condition wherein a piston is raised.
Figure 10:
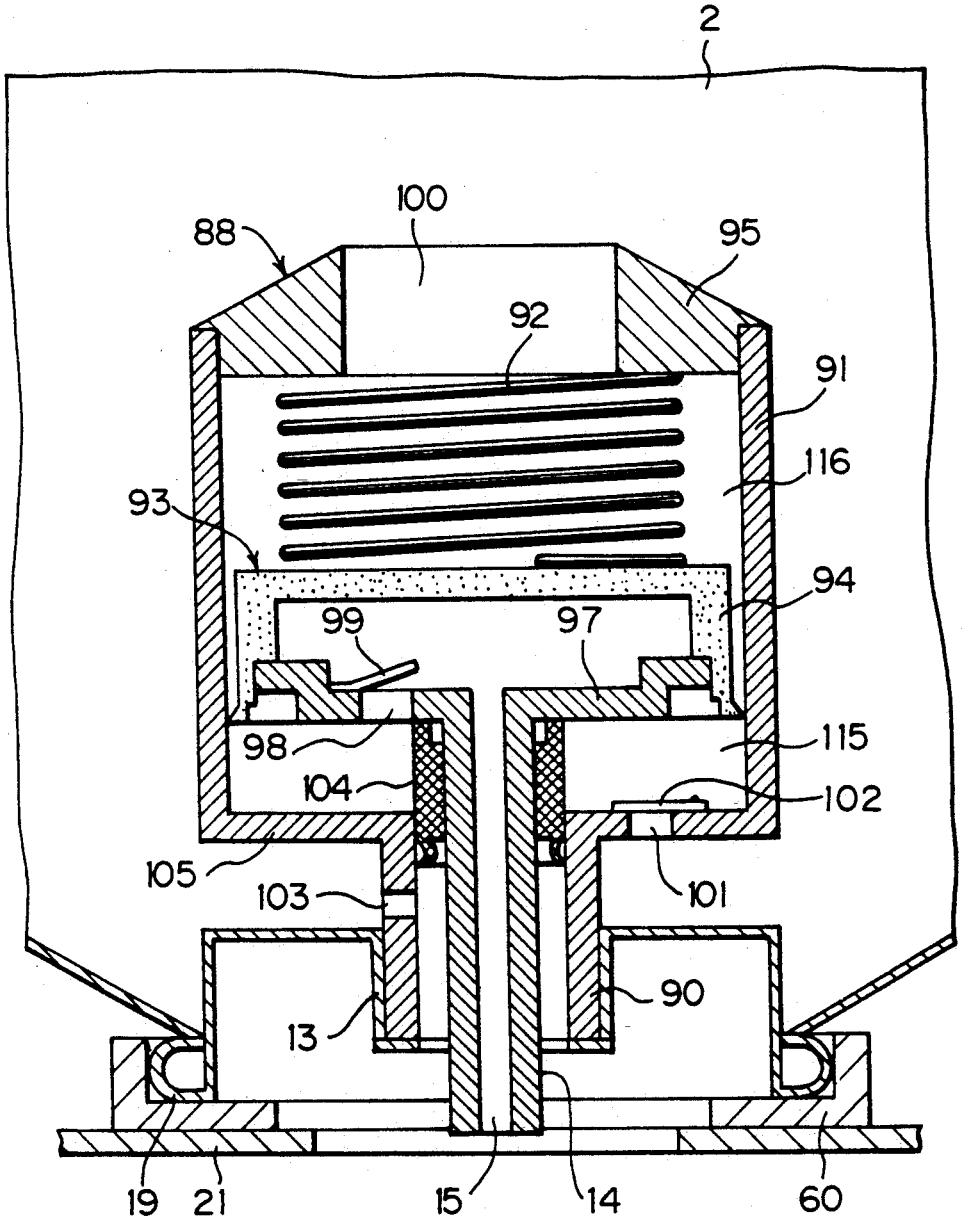
FIG. 10 is a view similar to FIG. 8, showing a condition wherein the piston is lowered.

FIGS. 8–10 show a pump 88 which is a specific form of discharging means incorporated in the toner container 2. As shown, the toner container 2 has a tubular portion 90 at the bottom which is affixed to the mouth 13. A cylinder 91 has a top wall 95 through which an opening 100 is formed. A piston 93 is received in the cylinder 91 and constantly biased downwardly by a spring 92. The piston 93 has a hollow piston head 94 and the previously mentioned nozzle 14 movable up and down in the tubular portion 90. An opening 98 is formed through the bottom wall 97 of the piston head 94. A valve 99 is fitted on the bottom wall 97 above the opening 98 such that it communicates the cylinder 91 and piston head 94 when the piston 93 is lowered. An opening 101 is formed through the bottom wall 105 of the cylinder 91. A valve 102 is associated with the opening 101 such that it communicates the inside and the outside of the cylinder 91 when the piston 93 is raised. A vent 103 is formed through the tubular portion 90. A seal member 104 is disposed between the tubular portion 90 and the nozzle 14.

Figure 11:
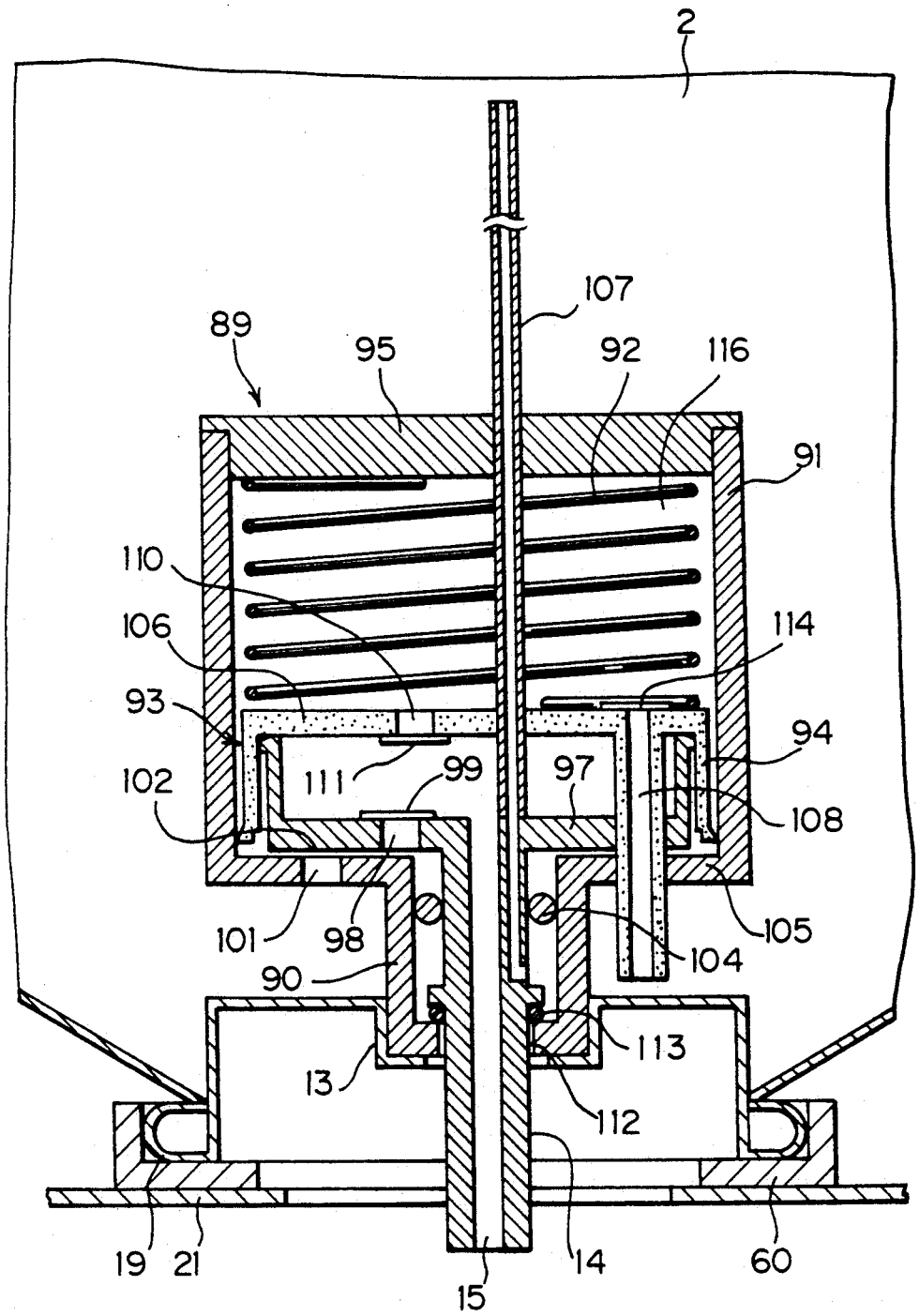
FIG. 11 is a vertical section showing the mouth portion of the toner container included embodiment and having another specific configuration in a closed position.
Figure 12:
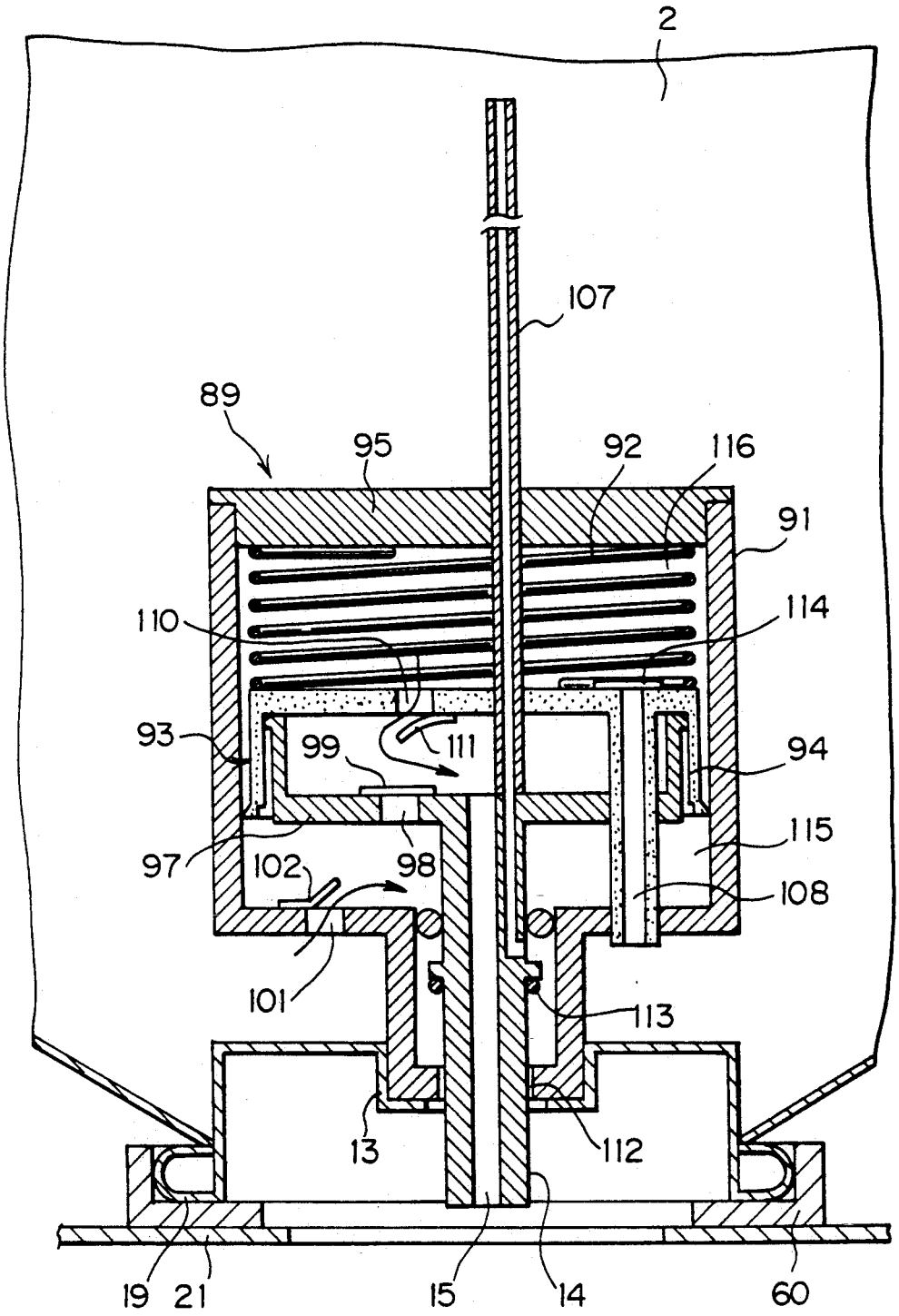
FIG. 12 is a vertical section showing a condition wherein a piston included in the toner container of FIG. 11 is raised.
Figure 13:
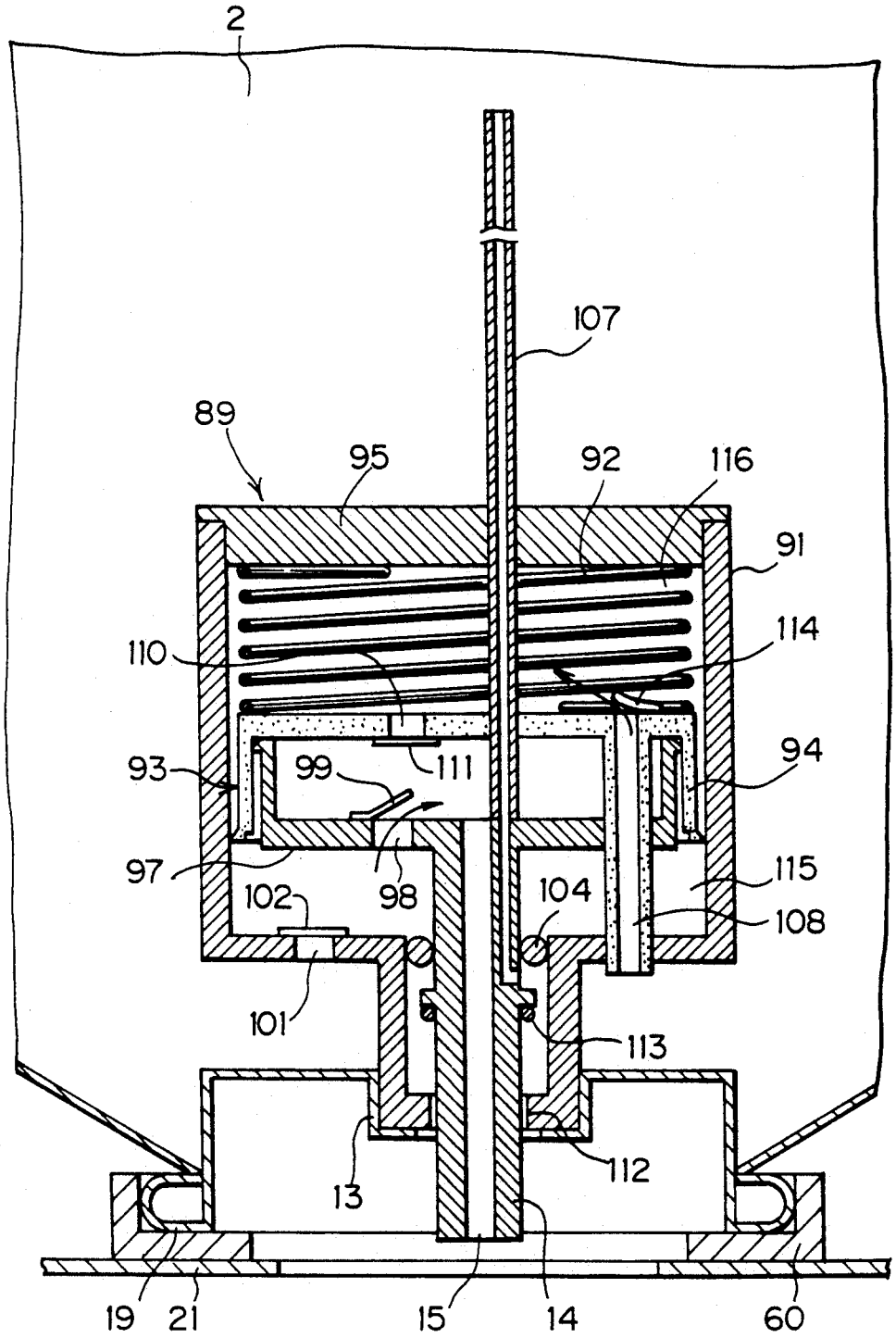
FIG. 13 is a view similar to FIG. 12, showing a condition wherein the piston is lowered.

FIGS. 11–13 shows a pump 89 which is another specific form of the discharging means of the toner container 2. In the figures, the parts or elements are designated by like reference numerals, and redundant description will be avoided for simplicity. As shown, the top wall 95 of the cylinder 91 is not formed with an opening. A vent tube 107 extends throughout the top wall 95 of the cylinder 91. The upper end of the vent tube 107 is open to the outside of the cylinder 91 while the lower end of the same is open at the outer periphery of the nozzle 14. The piston head 94 has a suction tube 108 which is received in an opening formed through the bottom wall 105 of the cylinder 91. The upper end of the suction tube 108 is open while the lower end of the same is open to the outside of the cylinder 91. An opening 110 is formed through the top wall 106 of the piston head 94. A valve 111 is associated with the opening 110 such that it communicates the inside and the outside of the piston head 94 when the piston 93 is raised. A clearance 112 for replacement of air exists between the lower inner periphery of the tubular portion 90 and the nozzle 14 and is sealed by a lower seal member 113 in a closed position shown in FIG. 11.

Referring again to FIG. 1, to set the toner container 2 on the reservoir 1, the hook 33 is rotated clockwise to release it from the locking portion 37, and then the front cover 26 is rotated to a position indicated by a phantom line. As a result, the inner holder 23 and toner container 2 are rotated in the same direction due to the engagement of the pin 35 and slot 28. In this condition, the used toner container 2 is removed, then a fresh toner container 2 is inserted in the inner holder 23, and then the front cover 26 is rotated in the opposite direction. The spring 31 causes the inner holder 23 to stand on the base plate 21. As the front cover 26 reaches a closed position shown in FIG. 1, the hook 33 mates with the locking portion 37 when the inclined surface of the former passes the latter.

While the front cover 26 is moved toward the above-mentioned closed position, the pin 40, FIG. 2, studded on the cover bracket 27 pushes the pressure receiving portion 53 of the auxiliary pressing plate 44. As a result, the pressing plate 38 is lowered until the pressing portion 52 thereof abuts against the top of the toner container 2, thereby setting the toner container 2. As the pin 40 is further lowered, the projection 48 of the auxiliary pressing plate 44 urges the pressing plate 38 which in turn further pushes the toner container 2. Consequently, the annular portion 19 and the tip of the nozzle 14 are urged against the seat 60 and the packing 71, respectively. At this instant, the nozzle hole 15 and the hole 75 of packing 71 are communicated to each other. It has been customary with the toner container 2 to provide a seat for receiving the mouth 13 on the base plate 21. Such a configuration has a problem that the clearance between the nozzle 14 and the container body available for the suction of air into the toner container 2 is extremely small, the container 2 is apt to such the toner and/or the developer existing in the clearance to thereby prevent air from entering it. The embodiment eliminates this problem due to the above-stated unique configuration.

Figure 7:
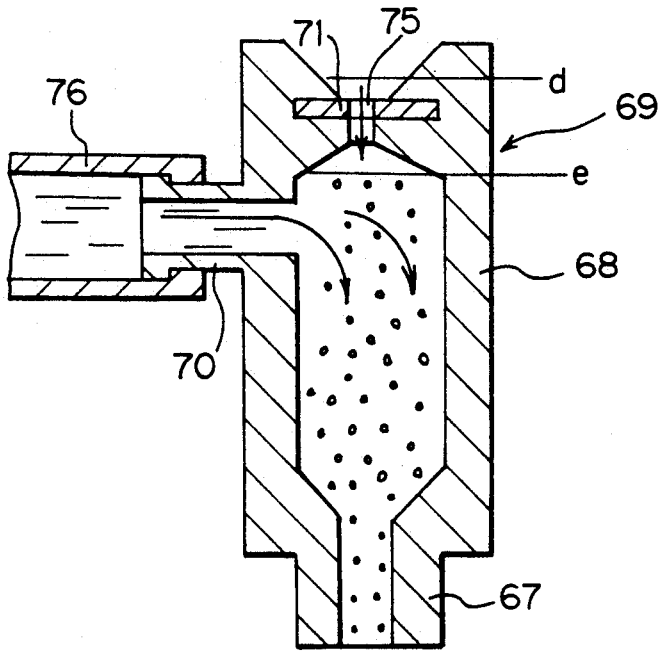
FIG. 7 is a section of a joint member included in the embodiment.

The developer supply pump 4 is operated with the tip of the nozzle 14 of the toner container 2 and the packing 71 of the joint member 69 contacting each other at a level slightly above the stable liquid level d, FIG. 7, or the base plate 21. Then, the liquid developer is supplied to the developing unit by the tube 86. At the same time, the liquid is circulated through the circulation path defined by the tubes 74 and 76, joint member 69, and tube 78. Part of the liquid in circulation flows out of the joint member 69 via the opening 75, wetting the nozzle hole 15 and packing 71. The above-mentioned position of the packing 71 is successful in preventing air from entering the device even when the toner container 2 is removed from the device, since the packing 71 remains in the liquid.

FIG. 7 shows the mechanical arrangement of the joint 69 which defines the passage for the liquid to flow when the nozzle 14 is not in close contact with the packing 71, i.e., when the toner container is not set.

The developing device of the present invention is constructed in such a manner as to supplement a toner into the liquid circulation path, so that it may be transported by the liquid flowing through the circulation path. The absense of the toner container at the toner supply section is problematic. If the liquid level in the joint 69 is e as illustrated in FIG. 7, air will be entrained by the flow of the liquid (the pressure is negative since the pump draws liquid) and introduced in the liquid and, therefore, in the pump. The air in the pump would lower the pressure and prevent a required amount of liquid from being delivered. To eliminate this problem, it is necessary to configure the joint 69, such that the liquid overflows to the level d, as illustrated in FIG. 7.

As the previously mentioned concentration sensor generates a toner supply command, the solenoid 57 is energized to rotate the arm 56 to thereby raise the joint member 69 which supports the guide pin 72. At this instant, the joint member 69 is capable of rising straight since the tubular outlet 67 thereof moves smoothly in the opening 79 of the return tube 78 at the lower end and is supported by the packing 64 at the upper end.

The pump 88 implementing the discharging means of the toner container 2 is operated as follows. The joint member 69 being raised as stated above raises the piston 93 remaining in the closed position, FIG. 8, against the action of the spring 92, as shown in FIG. 9. As a result, the valve 102 is opened to admit the liquid from the outside of the cylinder 91 into a lower chamber 115 defined in the cylinder 91 via the opening 101. At this instant, the valve 99 is closed with the result that external air is admitted into the toner container 2 via the opening 103 and replaced with the sucked liquid. As soon as the joint member 69 and, therefore, the piston 93 stops rising, the piston 93 is lowered by the spring 92, as shown in FIG. 10. Consequently, the valve 99 is opened to discharge the liquid in the lower chamber 115 to the inside of the reservoir 1 via the opening 98, piston head 94, and nozzle hole 15.

The operation of the pump 89 which is another specific discharging means will be described. At first, the pump 89 is held in the closed position shown in FIG. 11. As the piston 93 is raised, as shown in FIG. 12, the valve 102 is operated in the same manner as in the pump 88 to suck the liquid into the lower chamber 115 of the cylinder 91. The valve 111 is opened to admit the liquid existing in an upper chamber 116 of the cylinder 91 into the piston head 94. At this instant, the valve 114 remains in the closed position. As shown in FIG. 13, when the piston 93 is lowered, the valve 99 is moved in the same manner as in the pump 88 to force the liquid from the lower chamber 115 into the reservoir 1. At the same time, the valve 114 is opened to admit the liquid into the upper chamber 116 from the outside of the cylinder 91 via the tube 108. At this instant, the valves 102 and 110 are held in their closed position.

In any of the pumps 88 and 89, the replacement of air is effected via the clearance 112 and vent tube 107. The liquid is fed into the lower chamber 115 of the cylinder 91 when the piston 93 is raised or into the upper chamber 116 when the piston 93 is lowered.

Figure 14:
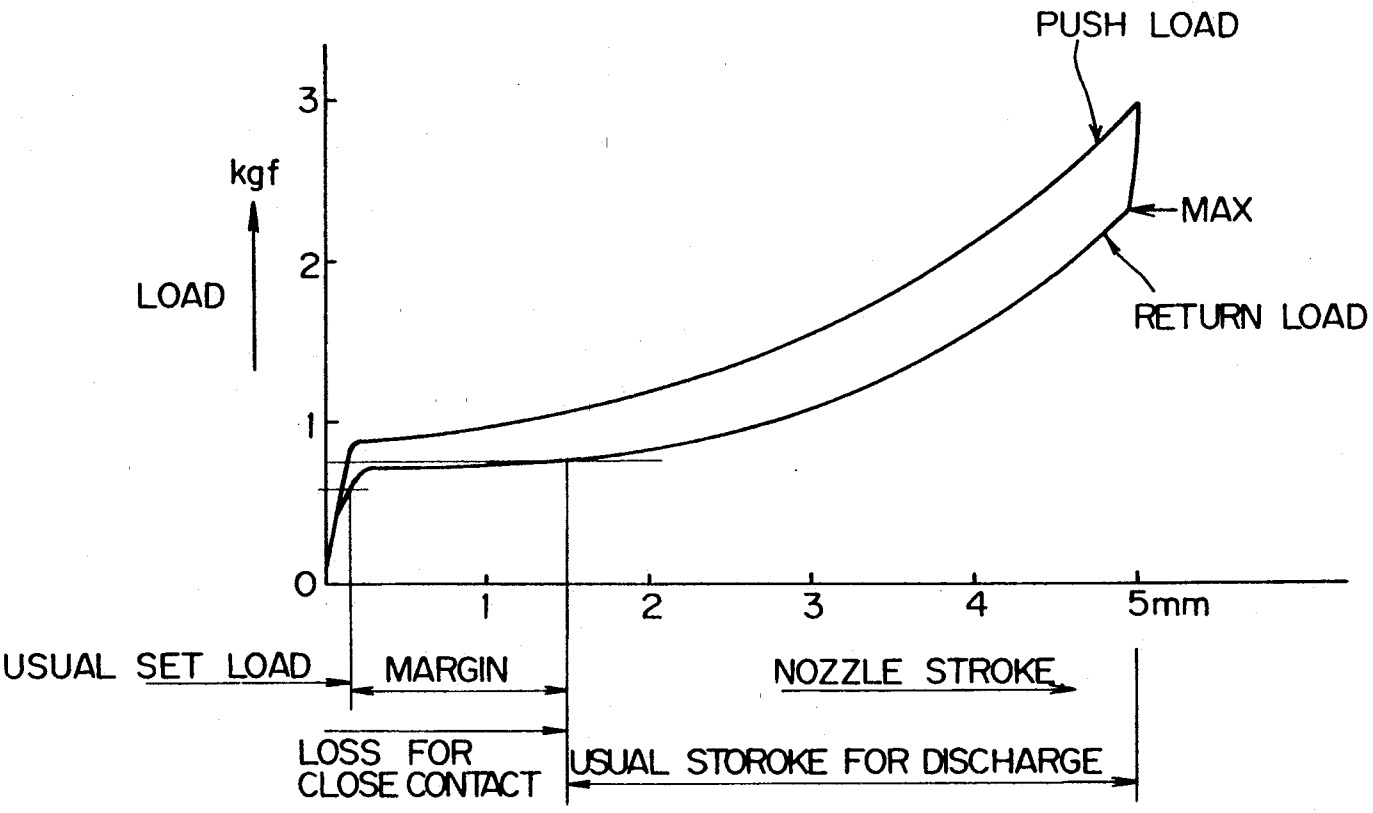
FIG. 14 is a graph indicative of a relation between the nozzle stroke and the load.

The force of the solenoid 57 for raising the nozzle 14 is determined on the basis of the balance among the force of the spring 92 included in the pumps 88 and 89, the resistance against the sliding movement of the piston 92, the resistance against the sliding movement of the seal members 104 and 113, the resistance acting between the vent tube 107 and the cylinder 91, the resistance acting on the toner, etc. However, while the returning force of the piston 92 is exerted by the spring 92, the various resistances against sliding movements counteract the return of the piston 92, reducing the returning force of the nozzle 14. Should the returning force of the nozzle 14 be weak, the next stroke of the nozzle 14 would not be obtained. Since the displacement of a pump is mostly determined by a change in volume due to the stroke of a piston and the seal efficiency, the incomplete return of a nozzle leads to a decrease in the displacement of the pump. However, the tip of the nozzle has to be held in close contact with the actuating means to prevent the toner from depositing and drying on to the tip of the nozzle. For this purpose, the biasing means 59 is included in the device. Although the load of the biasing means 59 changes as the stroke of the piston changes, it does not noticeably effect the resistances against sliding movements. The returning force has been weakened when the nozzle is returned over the last several millimeters; under usual conditions, the nozzle is used in part of the stroke which is short of the fully returned position. Although this correspondingly increases the stroke, it is possible to insure the close contact of the nozzle with the actuating means and the stroke implementing the necessary toner discharge. Hence, it is necessary to set up a contact pressure which is at least less than one-third of the returning load. Such a relation is shown in FIG. 14.

In summary, in accordance with the present invention, a toner container is provided with discharging means having a self-discharging function. The toner container, therefore, does not have to be implemented as a pressure container filled with a toxic gas which is apt to pollute the environment. Since the outlet of the toner container is open to a circulation path for circulating a liquid developer from and to developer feeding means in a reservoir, it is constantly dipped in the liquid with no regard to the liquid level of the reservoir and, therefore, free from the deposition of a toner. Biasing means constantly biases actuating means to hold it in close contact with the outlet of the toner container. This prevents the outlet from being accidentally opened. Otherwise, it is likely that air is admitted through the outlet and reduces the ability of developer feding means by way of the circulation path, or that while the developer feeding means is not in operation, the circulation path becomes empty to expose the outlet to air to thereby cause the toner to deposit and dry on the outlet. Since the force of the biasing means is less than at least one-third of the maximum operating force of a return load acting during the operation of the toner container, the close contact of the discharging means and the actuating means is insured. In addition, since the toner container is supported by supporting means at a position remote from a position where air is introduced into the container, it is prevented from sucking the toner and/or the liquid and, therefore, from failing to admit air thereinto.

Further, the outlet of the discharging means and the actuating means are connected together by the nozzle of the former and the packing of a joint member included in the latter. When the nozzle is pressed for supplying the toner, the base of the nozzle is spaced apart by at least 3 millimeters from a guide portion. This eliminates an occurrence that the nozzle sucks the toner existing in the guide portion, i.e., fails to suck air smoothly and thereby increases the discharge of the toner; should the toner container be depressurized, it would fail to discharge the toner in an expected manner.

Moreover, the self-discharging means of the toner container is implemented as a pump mechanism having a simple structure including a cylinder and a piston. This, coupled with the fact that the cylinder and piston are accurately synchronous to each other during toner supply, realizes inexpensive discharge and insures the supply of a predetermined amount of toner at a predetermined time.

Various modifications will become possible for those skilled in the art after receiving the teachings of the present disclosure without departing from the scope thereof.

What is claimed is:

1. A developing device for a copier using a liquid developer, comprising:

a reservoir for storing a liquid developer;

a toner container removably mounted on said reservoir, said toner container comprising a container body for storing a toner and discharging means having a nozzle with an outlet for discharging said toner to the outside of said container body through the nozzle and outlet, said discharging means being located within said container body and comprising a cylinder with a piston movable therein for dividing said cylinder into upper and lower chambers, said discharging means further comprising a resilient means in said upper chamber for urging said piston toward said lower chamber;

actuating means for urging said piston against said resilient means and towards the upper chamber and for allowing a predetermined amount of toner in said container body to enter into the lower chamber of the cylinder such that when said predetermined amount of toner is in said lower chamber, said resilient means forces said piston toward said lower chamber and thereby discharges said toner to the outside of said container body through said nozzle and outlet; and developer feeding means disposed in said reservoir for feeding the liquid developer to a developing unit wherein said outlet of said discharging means is open to a circulation path for circulating the liquid developer from and to said developer feeding means.

2. A developing device as claimed in claim 1, further comprising biasing means for biasing said actuating means such that said outlet of said discharging means and part of said actuating means constantly contact each other closely when said toner container is mounted on said reservoir.

3. A developing device as claimed in claim 2, wherein said biasing means exerts a force which is at least less than one-third of a maximum operating force on said piston during the discharge of said toner.

4. A developing device as claimed in claim 1, further comprising supporting means for supporting said toner container at a position other than a mouth portion of said toner container;

said actuating means being held in close contact with said nozzle for causing the toner to be discharged;

said supporting means supporting said toner container at a position remote from an opening formed in said toner container for introducing air into said toner container.

5. A developing device as claimed in claim 1, wherein said toner container comprises a mouth portion thereof and said discharging means is located at said mouth portion;

said cylinder defining a tubular portion fitted in said mouth portion, and said resilient means being a spring for constantly downwardly biasing said piston; and said piston is attached to said nozzle and is movable up and down in said tubular portion, said piston defining a hollow piston head connected to said nozzle;

said discharging means further comprising a piston valve mounted on a bottom wall of said piston head for communicating said cylinder and said piston head when said piston is lowered, and a cylinder valve is mounted on a bottom wall of said cylinder for communicating the inside and the outside of said cylinder when said piston is raised.

6. A developing device as claimed in claim 5, wherein said piston head comprises a vent tube extending throughout a top wall of said cylinder and defining a fluid path which is open to the outside of said cylinder at an upper end and open to the outer periphery of said nozzle at a lower end.

7. A developing device as claimed in claim 6, wherein said cylinder comprises a suction tube extending throughout the bottom wall of said cylinder, open to the outside of said cylinder at a lower end, and provided with said piston valve at an open upper end.

8. A developing device as claimed in claim 7, further comprising a piston valve fitted on the rear of a top wall of said piston head for communicating said upper chamber defined in said cylinder and said piston head when said piston is raised.

* * * * *